US006868610B2

(12) United States Patent
Brandt et al.

(10) Patent No.: US 6,868,610 B2
(45) Date of Patent: Mar. 22, 2005

(54) SHAVING RAZORS AND RAZOR CARTRIDGES

(75) Inventors: Klaus Brandt, Wellesley, MA (US); Stuart M. Davis, Norfolk, MA (US); Kenneth T. Dodd, Upton, MA (US); Charles Robert Parent, Westwood, MA (US); Andrew Szczepanowski, Walpole, MA (US); Douglas J. Woodnorth, Needham, MA (US)

(73) Assignee: The Gillette Company, Boston, MA (US)

( * ) Notice: Subject to any disclaimer, the term of this patent is extended or adjusted under 35 U.S.C. 154(b) by 64 days.

(21) Appl. No.: 10/002,920

(22) Filed: Nov. 15, 2001

(65) Prior Publication Data

US 2003/0088984 A1 May 15, 2003

(51) Int. Cl.[7] ..... B26B 21/48
(52) U.S. Cl. ..... 30/41; 30/34.05; 30/140
(58) Field of Search ..... 30/32, 34.05, 41, 30/123, 140

(56) References Cited

U.S. PATENT DOCUMENTS

| | | | | | |
|---|---|---|---|---|---|
| 1,552,026 | A | * | 9/1925 | Barra | 30/34.05 |
| 1,821,574 | A | | 9/1931 | Peters | |
| 2,225,257 | A | * | 12/1940 | Conill | 30/34.05 |
| 2,295,508 | A | | 10/1942 | Peters | |
| 2,324,148 | A | | 7/1943 | Gravin | |
| 4,170,821 | A | * | 10/1979 | Booth | 30/41 |
| 4,690,724 | A | | 9/1987 | Outlaw | |
| 4,692,986 | A | * | 9/1987 | Motta et al. | 30/34.05 |
| 4,872,263 | A | * | 10/1989 | Etheredge, III | 30/41 |
| 5,065,515 | A | | 11/1991 | Iderosa | 30/140 |
| 5,113,585 | A | | 5/1992 | Rogers et al. | |
| 5,331,740 | A | | 7/1994 | Carson, III et al. | |
| 5,456,852 | A | * | 10/1995 | Isiguro | 252/70 |
| 5,653,025 | A | | 8/1997 | Cheng et al. | 30/41 |
| 5,889,257 | A | | 3/1999 | Schader et al. | |
| 5,903,979 | A | * | 5/1999 | Oldroyd | 30/41 |
| 6,048,919 | A | | 4/2000 | McCullough | |
| 6,149,981 | A | * | 11/2000 | Chadwick et al. | 30/41 |
| 6,251,978 | B1 | | 6/2001 | McCullough | |
| 2001/0048172 | A1 | | 12/2001 | Smith et al. | |
| 2002/0025998 | A1 | | 2/2002 | McCullough et al. | |
| 2003/0040563 | A1 | | 2/2003 | Sagal et al. | |
| 2003/0044631 | A1 | | 3/2003 | Sagal et al. | |
| 2003/0046816 | A1 | | 3/2003 | Kanzer | |
| 2003/0088984 | A1 | | 5/2003 | Brandt et al. | |

FOREIGN PATENT DOCUMENTS

| | | |
|---|---|---|
| GB | 149265 | 10/1921 |
| GB | 2 181 380 | 4/1987 |

* cited by examiner

*Primary Examiner*—Hwei-Siu Payer
(74) *Attorney, Agent, or Firm*—Fish & Richardson P.C.

(57) ABSTRACT

Shaving razors and cartridges are provided that impart warmth to a user's skin during shaving. The razors and cartridges include a phase change material.

48 Claims, 4 Drawing Sheets

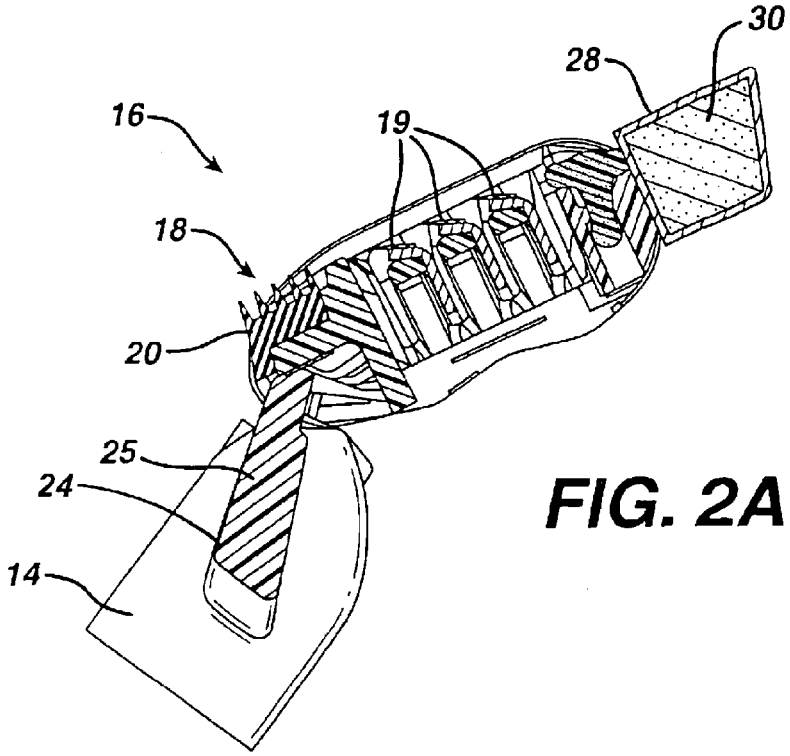
FIG. 2A
FIG. 3
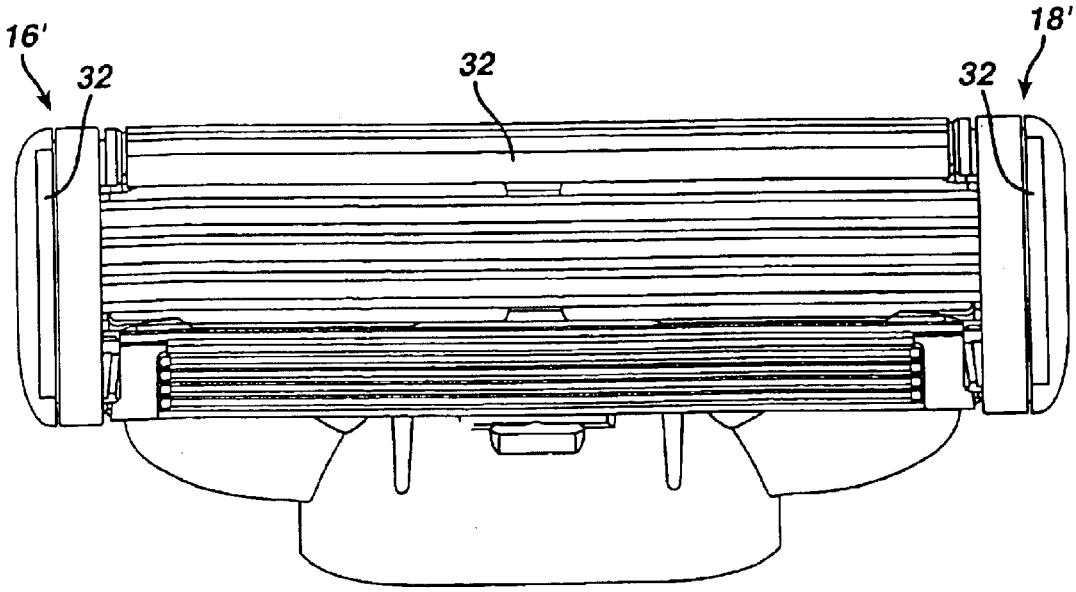

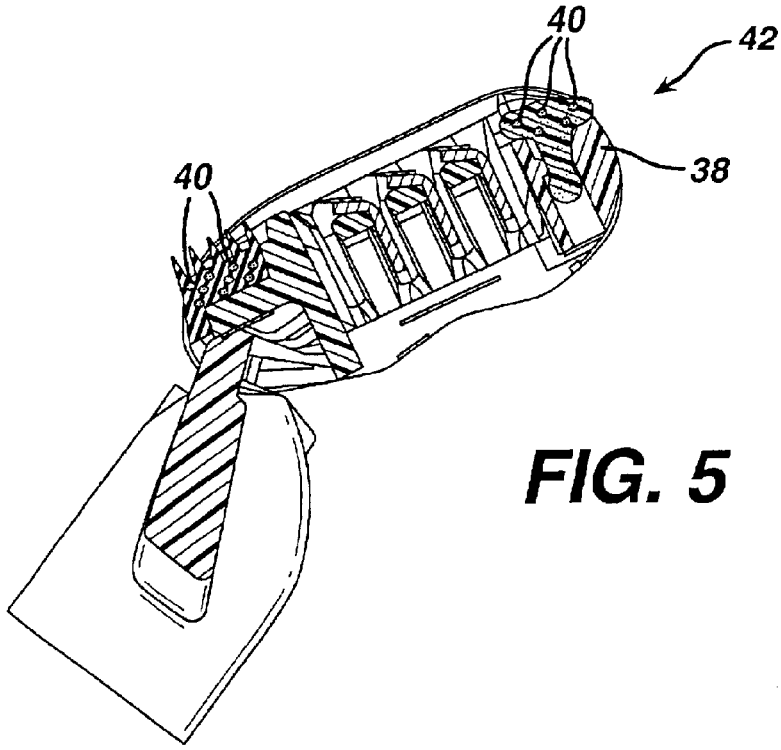
FIG. 5
FIG. 6
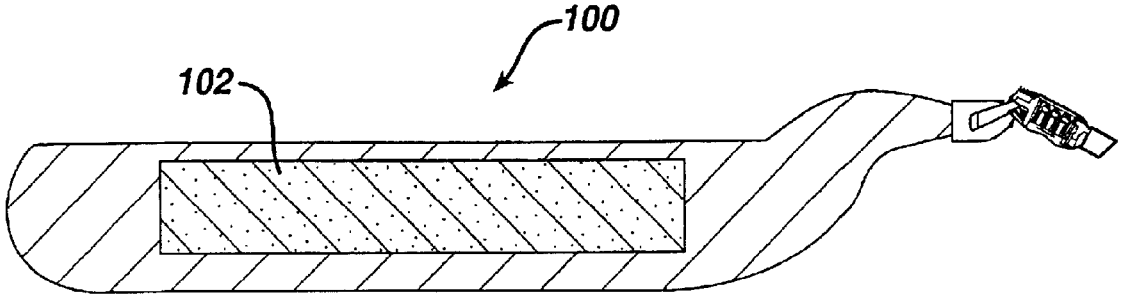

SHAVING RAZORS AND RAZOR CARTRIDGES

TECHNICAL FIELD

This invention relates to shaving razors and razor cartridges.

BACKGROUND

Users of wet-shave razors generally appreciate a feeling of warmth against their skin during shaving. The warmth feels good, and also causes the user's skin to hydrate and beard to soften, resulting in a more comfortable shave.

Various attempts have been made to provide a warm feeling during shaving. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery.

SUMMARY

The invention features razors that include a phase change material that is capable of delivering heat to a use's skin. Phase change materials store latent heat when melted, and release it during recrystallization. The phase change material in the razor is a solid at room temperature, and can be easily melted, "thermally charging" the razor, by holding the razor under warm running water or immersing the razor in warm water. (The phase change material is enclosed in the razor so that it does not flow out when melted.) When the thermally charged razor is used, as the melted phase change material recrystallizes it will release heat in a controlled manner, at a specific temperature (the melting point of the phase change material) imparting a warm feeling to the user's skin.

Generally, the temperature of the phase change material will not exceed the melting temperature of the material for any significant period of time (i.e., more than a second or two), even if the razor is exposed to a higher temperature (e.g., scalding water) during the melting phase. The temperature of the razor will not exceed the melting point of the phase change material until all of the phase change material has melted. Therefore, it is unlikely that a razor with a phase change material will become uncomfortably hot even if exposed to higher temperatures.

The razors of the invention do not require a power supply, other than warm water, which is generally readily available when shaving. Razors of the invention can be manufactured relatively inexpensively, and are safe and reliable in use. The large latent heat capacity of the phase change material gives shavers the sensation of handling an instrument with a large thermal mass, an attribute usually associated with quality, while maintaining a low mechanical mass for ease of shaving.

In one aspect, the invention features a razor including a handle, a head, mounted on the handle, and within the head, a phase change material. The phrase "within the head" includes any portion of the head, for example providing the phase change material within the housing in which the blades are mounted, or providing the phase change material in a capsule or other member that is mounted on or otherwise associated with the housing.

Some implementations may include one or more of the following features. The phase change material has a melting point between about 30 and 50 degrees C., e.g., between about 32 and 45 degrees C. The razor has a discharging interval of greater than 15 seconds. The razor has a recharging time of less than 10 seconds, preferably less than 5 seconds. The head contains from about 0.1 to 0.5 $cm^3$ of the phase change material. The head contains a sufficient quantity of the phase change material so that the temperature of the head will not exceed the melting temperature of the phase change material under normal use conditions. The phase change material is microencapsulated and the microcapsules are dispersed through the material of the head. The phase change material is disposed in a chamber within the head.

The phase change material may include a paraffin, a low melting salt, a low melting salt containing water of crystallization, a low melting eutectic mixture of organic or inorganic compounds, a low melting metals or alloys. The phase change material may include an alkyl carboxylic acid. The phase change material may be selected from the group consisting of undecanoic acid, decanoic acid, nonadecane, eicosane, and tridecanoic acid. In some implementations, the razor includes a plurality of phase change materials, e.g., phase change materials having different recrystallization/nucleation rates.

In some implementations, the razor further includes an indicator, visible to a user of the razor, constructed to provide a visual indication, e.g., a color change, showing whether the razor is thermally charged. The indicator may include one or more of the following features. The indicator includes a thermochromic material. The indicator includes a strip positioned on the razor head. The indicator includes a thermochromic material distributed through the material of the head or coated on a surface of the head. The indicator is constructed to indicate the degree to which the razor is thermally charged. The indicator includes a plurality of thermochromic materials having different color change temperatures. The indicator displays an alphanumeric indicia or logo to indicate when the razor is thermally charged. The indicia or logo appears when the razor is thermally charged.

In some implementations, a portion of the razor further includes a lubricating agent. The phase change material may be disposed in the portion of the razor containing the lubricating agent. For example, if the phase change material is microencapsulated the microcapsules are distributed through the material of the portion of the head containing the lubricating agent. The head may include a strip constructed to deliver a lubricious substance to the user's skin, and the the phase change material may be positioned with respect to the strip so as to increase the rate of delivery of the lubricious substance relative to the rate at which it would be delivered if the phase change material were not present. For example, the phase change material may be incorporated in the strip.

In some implementations, the razor includes heat transfer fins on the cartridge constructed to enhance heat transfer from hot water to the cartridge. Alternatively or in addition, the razor may include a thermally conductive material, e.g., a metal wool or metal foam, positioned adjacent the phase change material to enhance thermal energy transfer to and from the phase change material.

The invention also features razor cartridges that include a phase change material within the cartridge housing.

In another aspect, the invention features a razor including a handle, a head, mounted on the handle, and within the handle, a phase change material.

The invention also features a method of shaving including: (a) contacting a razor head containing a phase change material with water that is sufficiently warm to melt the phase change material, and then, (b) contacting the skin with the razor head.

Steps (a) and (b) may be repeated a plurality of times during shaving.

The term "razor", as used herein, unless otherwise indicated refers both to razors that include a handle and a replaceable cartridge, and to disposable razors in which the razor head is fixedly mounted on a handle.

Other features and advantages of the invention will be apparent from the detailed description and drawings, and from the claims.

DESCRIPTION OF DRAWINGS

FIG. 2A is a cross-sectional view of the razor cartridge shown in FIG. 1, taken along line A—A in FIG. 2.

FIG. 3 is a front plan view of a razor cartridge according to an alternate embodiment of the invention.

FIG. 5 is a cross-sectional view of a razor cartridge according to an alternate embodiment of the invention.

FIG. 6 is a cross-sectional view of a razor according to an alternate embodiment of the invention.

DETAILED DESCRIPTION

Figure 1:
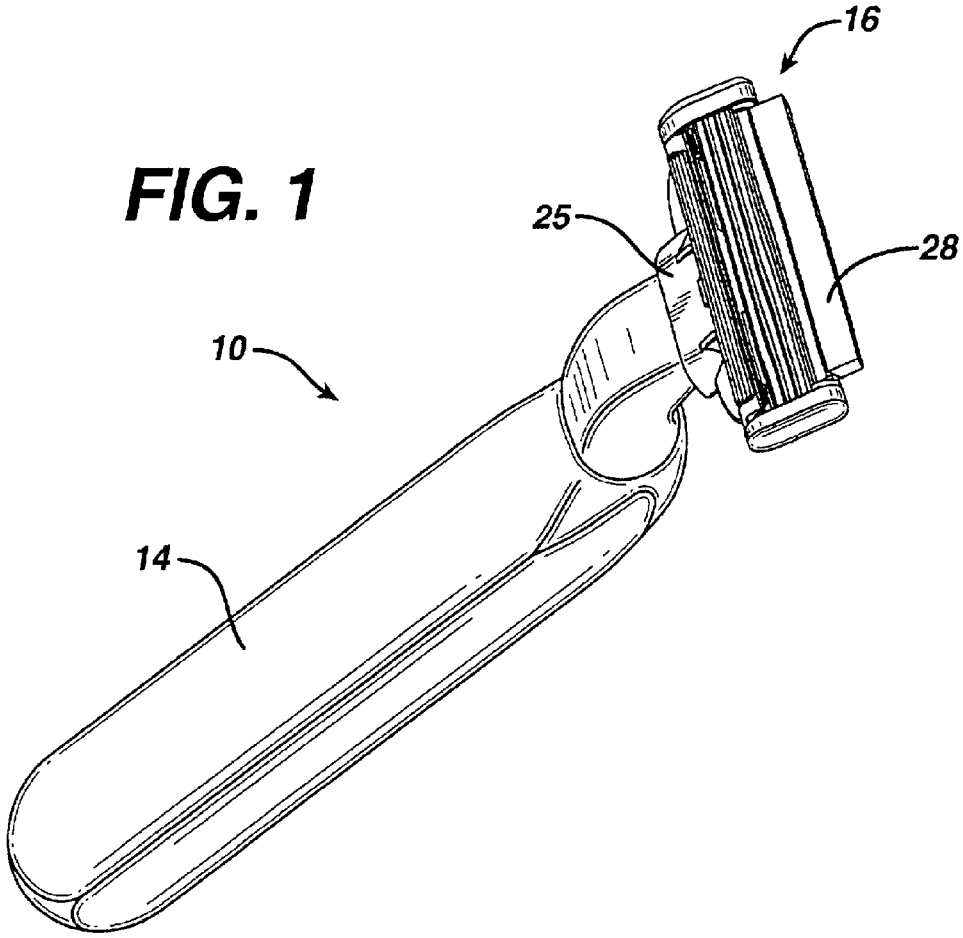
FIG. 1 is a perspective view of a razor according to one embodiment of the invention.
Figure 2:
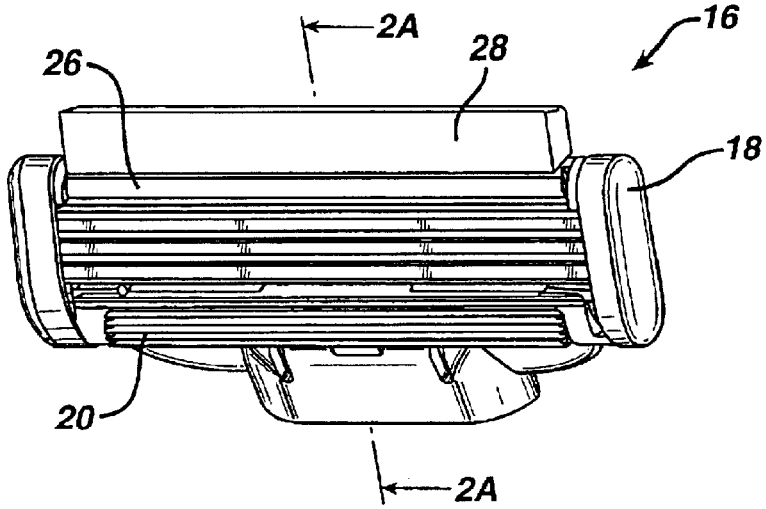
FIG. 2 is an enlarged perspective view of the razor cartridge shown in FIG. 1.

Referring to FIG. 1, a razor 10 includes a handle 14, and, mounted on the handle, a razor cartridge 16. Referring to FIGS. 2 and 2A, razor cartridge 16 includes a molded plastic housing 18, which carries a plurality of blades 19 and includes a guard 20. Cartridge 16 also includes recesses 24 constructed to receive an interconnect member 25 on handle 14, on which housing 18 is pivotally mounted. Interconnect member 25 removably and fixedly attaches the housing 18 to the handle.

Guard 20 includes a finned unit molded on the front of housing 16 to engage and stretch the user's skin; other skin engaging protrusions, e.g., as described in U.S. Pat. No. 5,191,712, which is hereby incorporated by reference, can be used. Guard 20 may be formed of elastomeric material, or may be formed of the same material as the rest of housing 16. Preferably, the fins are progressively taller toward the blades 19, so as to lift the hair gradually for a closer, more comfortable shave.

The razor cartridge 16 may also include other components that improve the performance or extend the life of the cartridge. For example, a piece of aluminum (not shown) may be included at one end to act as a sacrificial anode. Also, a shaving aid composite 26 may be provided at the upper edge of the housing 16 to deliver a lubricious substance to the user's skin, e.g., as described in U.S. Pat. Nos. 5,113,585 and 5,454,164, the disclosures of which are hereby incorporated by reference.

A capsule 28, containing a phase change material 30 (FIG. 2A) is mounted on the housing 18. When the capsule is placed under hot running water, or immersed in hot water, the phase change material 30 melts, charging the razor as discussed above.

Preferably, the capsule 28 is formed of a material having a relatively high thermal conductivity, e.g., metal. Alternatively, the capsule 28 may be formed of a material having a lower thermal conductivity, e.g., plastic, provided that the wall thickness of the capsule is sufficiently thin to allow adequate heat transfer.

In an alternative embodiment, shown in FIG. 3, housing 18' of razor cartridge 16' includes a plurality of chambers 32. Chambers 32 are shown empty, for clarity, but in the finished product are filled with phase change material and sealed with covers (not shown). The covers may be opaque or transparent. As discussed above with regard to capsule 28, preferably the covers are either formed of a high thermal conductivity material or are sufficiently thin to allow good heat transfer to and from the phase change material.

Suitable phase change materials have a melting temperature between skin temperature and the typical temperature of hot tap water. Thus, the preferred melting temperature range is generally between about 30 and 50° C. Melting temperatures between about 32 and 45° C. are generally preferred, and temperatures between about 35 and 42° C. are thought to be optimal for many applications. Phase change materials having relatively high melting points (e.g., 40–50° C.) generally provide a desirably high level of warmth to the user, but tend to take longer to melt and discharge their latent heat more quickly (due to the larger thermal gradient with the user's skin).

Suitable phase change materials include paraffins, alkyl carboxylic acids and various inorganic salt hydrates. Preferred phase change materials include undecanoic acid, decanoic acid, nonadecane, eicosane, and tridecanoic acid. Other suitable phase change materials include low melting salts, low melting salts containing water of crystallization, low melting eutectic mixtures of organic or inorganic compounds, low melting metals and alloys.

It is generally preferred that the razor have a short "recharging time", i.e., that the razor can be thermally charged by holding the razor head under hot tap water (about 40–50° C.) for a relatively short period of time. For this purpose, it is preferred that the razor include means to enhance heat transfer from the hot water stream to the razor (e.g., heat transfer fins on the razor) and means to enhance heat transfer within the phase change material capsule (e.g., a low volume fraction of a high thermal conductivity material in the phase change material capsule). The razor is considered to be fully thermally charged when substantially all of the phase change material in the razor has melted. Preferably, the recharging time is less than about 10 seconds, preferably less than about 5 seconds, when the razor is held under running tap water at 45° C.

The lower the melting temperature of the phase change material, the shorter the recharging time will be. The volume of phase change material contained in the razor will also affect the recharging time. Generally, the more phase change material is used, the longer the recharging time will be.

It is not necessary that the razor be fully thermally charged prior to use; the razor will impart a warm feeling even if not all of the phase change material is melted. Generally, if at least 0.2 $cm^3$ of material melts, heat will be perceived by the user. In fact, it may be advantageous for some of the phase change material to remain unmelted. When all of the phase change material is melted, the temperature of the phase change material may exceed its melting temperature (e.g., if the temperature of the tap water is significantly higher than the melting temperature of the material). If the tap water were very hot, this could cause brief overheating of the phase change material, resulting in a razor temperature that could be uncomfortable to the user. If sufficient phase change material is used so that it is unlikely that it will all melt during a normal recharging interval, the phase change material can serve a "thermostat" function, preventing overheating of the razor head.

However, generally even if the temperature of the phase change material does exceed its melting temperature, the phase change material will return to its melting temperature after it is removed from the water much more quickly than it will discharge its latent heat. This rapid return to the melting temperature occurs because the latent heat of phase change materials is generally much larger than the specific heat capacity of the material times any reasonably encountered temperature excursion above the phase change material melting point.

Another criteria in the design of the razor is the discharging interval, i.e., the time period during which the razor releases heat. The discharging interval may be measured by first fully charging the razor, e.g., by immersing the head in water at a temperature slightly above the melting temperature of the phase change material used for a time sufficient to melt all of the phase change material, and then determining the length of time over which the razor releases latent heat. When the temperature of the phase change material drops lower than its melting point no further latent heat will be released. The discharging interval is preferably greater than 15 seconds, e.g., from about 15 seconds to 3 minutes. Because most users rinse their razors frequently, generally a long discharging interval is not necessary. The razor will be recharged during each rinse, if the user rinses with warm water. In applications in which it is believed that the user will rinse infrequently, or rinse with cool water, a relatively long discharging interval, e.g., 2–3 minutes, is preferred.

Discharging interval is dependent on melting point; the higher the melting point, the higher the thermal gradient between the user's face and the razor, as discussed above. Discharging interval is also dependent on the volume of phase change material used; the more phase change material, the longer the discharging interval will be. It is also desirable to design the cartridge such that it releases heat preferentially toward the face and at a rate that is just sufficient to maintain a sensation of warmth to the shaver.

The preferred volume of phase change material in the razor will depend on the factors discussed above. Generally, 0.1 to 0.5 $cm^3$ will provide a suitable balance of properties. Preferably, a sufficient amount of phase change material is included to provide a power output of about 1.0 to 3.0 W for 10–60 seconds. The amount of phase change material that can be included will generally be limited by design constraints, e.g., the amount of available volume in the razor head or cartridge housing. Thus, it is preferred that the phase change material have a high latent heat of fusion per unit volume, so that a relatively small volume of phase change material will store a relatively large amount of energy. Suitable phase change materials generally have a latent heat of fusion per unit volume of from about 100 to 500 kilojoules/decimeter$^3$ (kj/dm$^3$).

In an alternate embodiment, the phase change material is microencapsulated, and the microcapsules are distributed throughout the head or a portion of the head, e.g., as shown in FIG. 5, in which housing 38 of razor cartridge 42 includes microcapsules 40 (shown highly enlarged for clarity). Microencapsulated phase change materials are commercially available. Such materials have been used in thermal clothing, e.g., by Gateway Technologies and Outlast Technologies.

In another alternate embodiment, the phase change material may be a wax that is absorbed into a secondary supporting structure such as diatomaceous earth (e.g., Rubitherm GR phase change material from Rubitherm GmbH), silica (e.g., Rubitherm PI/PO phase change material, from Rubitherm GmbH), or a crosslinked polymer (e.g., Rubitherm PK phase change material). These materials may be distributed throughout the head or a portion of the head.

It may be desirable to include an indicator that will provide a visual indication to the user of whether the razor is charged. Including such an indicator will prevent the user from needlessly wasting time and energy holding the razor head under the water longer than is necessary. The indicator can also prevent the user from overheating the razor, by holding the razor head under excessively hot water (water which is significantly hotter than the melting point of the phase change material) longer than is needed to charge the razor.

Preferably, the indicator includes a thermochromic material that changes color in response to a temperature change. The indicator may include two or more different thermochromic materials that change color at different temperatures. For example, the indicator may include a first thermochromic material that turns blue when the razor head is at ambient temperature, a second thermochromic material that turns green when the razor head is within the desired temperature range, and a third thermochromic material that turns orange when the razor head is above the desired temperature range. As another example, the indicator may include a first thermochromic material that turns orange just above the melting point of the phase change material, and a second thermochromic material that turns blue just below the melting point of the phase change material. In this case, if the indicator were orange, this would indicate that substantially all of the phase change material had melted, as the temperature of the phase change material generally would not exceed its melting temperature until all of the material had melted.

Many other combinations of thermochromic materials may be used. Thermochromic materials can also be combined with non-themiochromic dyes and/or pigments to obtain desired colors.

Figure 4:
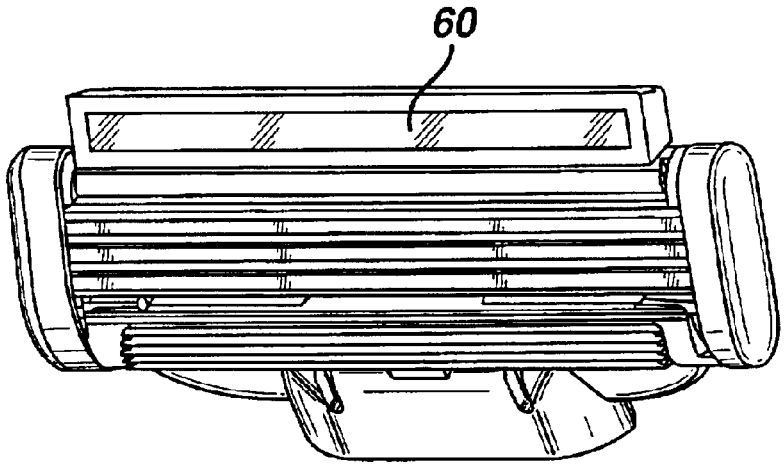
FIG. 4 is a perspective view of a razor cartridge according to an alternate embodiment of the invention.
Figure 4A:
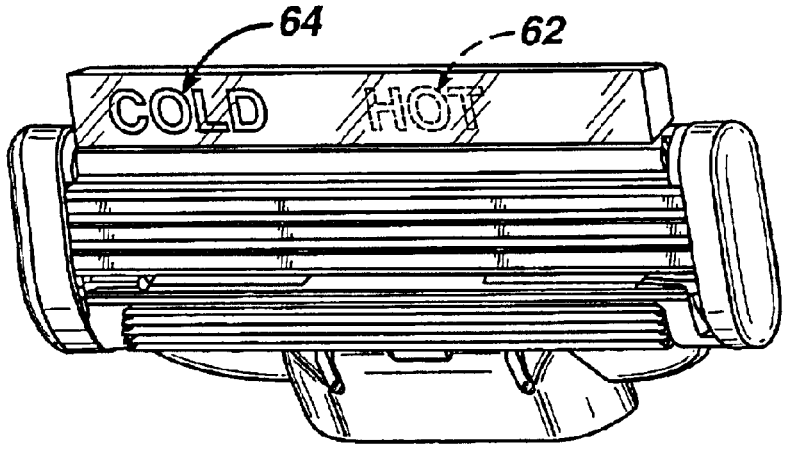
FIG. 4A is a perspective view of a razor cartridge according to another alternate embodiment of the invention.

The indicator may be in the form of a strip 60 that is mounted on or molded into the razor cartridge housing, as shown in FIG. 4. In this case, different thermochromic materials may be positioned at intervals along the strip. Alternatively, the indicator may be in the form of letters or other indicia that appear and disappear, e.g., "HOT" (62) and "COLD" (64), as shown in FIG. 4A. Indicia may be provided, for example, by forming indicia that include thermochromic materials, or by providing non-thermochromic indicia that are obscured by a thermochromic coating that becomes translucent at a predetermined temperature.

In other implementations, the thermochromic material may be compounded with the plastic of the razor head or cartridge housing, or may be blended with the phase change material if a transparent window is provided through which the phase change material may be viewed by the user. The thermochromic material may also be coated on the housing.

Although a thermochromic indicator is desirable from the standpoints of readibility and simplicity, other indicators may be employed such as a liquid filled thermometer of various shapes or a compound bar type dial thermometer.

Other embodiments are within the scope of the following claims.

For example, the razor cartridge may include two or more phase change materials. The phase change materials may have different recrystallization/renucleation temperatures. Thus, the different materials will recrystallize at different rates, which may extend the length of the discharging interval, e.g., if one material begins to recrystallize just after another material has finished recrystallizing (and therefore lost its latent heat).

Additionally, the razor handle can include a phase change material, in addition to or instead of the phase change material in the head, e.g., as shown in FIG. 6, in which handle 100 includes a chamber 102, containing a phase change material. Alternatively, the phase change material may be microencapsulated, as described above. Providing a phase change material in the handle will give the user the option of heating up the handle for a pleasant, warm grip and enhanced tactile properties.

Moreover, the phase change material may be provided at any desired location in the head. For example, the phase change material may be incorporated into the shaving aid composite 26 (FIG. 2). In this case, heating of the phase change material may further facilitate release of the shaving aid from the composite.

Also, the head may include any desired number of chambers or capsules containing the phase change material.

The capsule(s) may include a thermally conductive material to promote faster heat transfer in and out of the capsule (s), e.g., a metal foam, such as copper foam, or a metal wool. Generally the capsule(s) would contain a low volume fraction of the conductive material. Fins or ribs may also be used to enhance heat transfer to and from the phase change material. The capsule(s) may also include through holes through which water may flow, provided that the holes are sufficiently small so as to prevent egress of the relatively high viscosity melted phase change material.

Additionally, while certain razor designs have been shown and described above by way of example, the phase change materials described herein may be used in any desired razor design. The phase change materials may be used in both men's and women's razors.

What is claimed is:

1. A razor comprising:

a handle, a head, mounted on the handle, and within the head, a phase change material.

2. The razor of claim 1 wherein the phase change material has a melting point between about 30 and 50 degrees C.

3. The razor of claim 1 wherein the phase change material has a melting point between about 32 and 45 degrees C.

4. The razor of claim 1 wherein the razor has a discharging interval of greater than 15 seconds.

5. The razor of claim 1 wherein the razor has a recharging time of less than 10 seconds.

6. The razor of claim 5 wherein the razor has a recharging time of less than 5 seconds.

7. The razor of claim 1 wherein the head contains from about 0.1 to 0.5 $cm^3$ of the phase change material.

8. The razor of claim 1 wherein the head contains a quantity of the phase change material wherein less than all of the phase change material will melt under normal use conditions.

9. The razor of claim 1 wherein the phase change material is microencapsulated and the microcapsules are dispersed through the material of the head.

10. The razor of claim 9 wherein the microcapsules are distributed through the material of a portion of the head containing a lubricating agent.

11. The razor of claim 1 wherein the phase change material is disposed in a chamber within the head.

12. The razor of claim 1 wherein the phase change material comprises a paraffin, a low melting salt, a low melting salt containing water of crystallization, a low melting eutectic mixture of organic or inorganic compounds, a low melting metals or alloys.

13. The razor of claim 1 wherein the phase change material comprises an alkyl carboxylic acid.

14. The razor of claim 1 wherein the phase change material is selected from the group consisting of undecanoic acid, decanoic acid, nonadecane, eicosane, and tridecanoic acid.

15. The razor of claim 14 wherein the phase change material is eicosane.

16. The razor of claim 14 wherein the phase change material is nonadecane.

17. The razor of claim 1 comprising a plurality of phase change materials.

18. The razor of claim 17 wherein said phase change materials have different recrystallization/nucleation rates.

19. The razor of claim 1 further comprising an indicator, visible to a user of the razor, constructed to provide a visual indication of whether the razor is thermally charged.

20. The razor of claim 19 wherein the visual indication comprises a color change.

21. The razor of claim 20 wherein the indicator comprises a thermochromic material.

22. The razor of claim 19 wherein the indicator comprises a strip positioned on the razor head.

23. The razor of claim 19 wherein the indicator comprises a thermochromic material distributed through the material of the head.

24. The razor of claim 19 wherein the indicator comprises a thermochromic material coated on a surface of the head.

25. The razor of claim 19 wherein the indicator is constructed to indicate the degree to which the razor is thermally charged.

26. The razor of claim 19 wherein the indicator comprises a plurality of thermochromic materials having different color change temperatures.

27. The razor of claim 19 wherein the indicator displays an alphanumeric indicia or logo to indicate when the razor is thermally charged.

28. The razor of claim 27 wherein the indicia or logo appears when the razor is thermally charged.

29. The razor of claim 1 wherein the phase change material is disposed in a portion of the head containing a lubricating agent.

30. The razor of claim 1 further comprising a thermally conductive material positioned adjacent the phase change material to enhance thermal energy transfer to and from the phase change material.

31. The razor of claim 30, wherein the thermally conductive material comprises a metal wool or metal foam.

32. The razor of claim 1 further comprising, on the head, a strip constructed to deliver a lubricious substance to a user's skin.

33. The razor of claim 32 wherein the phase change material is positioned with respect to the strip so as to increase the rate of delivery of the lubricious substance relative to the rate at which it would be delivered if the phase change material were not present.

34. A razor comprising:

a handle, a head, mounted on the handle, and within the head, a plurality of phase change materials, the phase change materials having different recrystallization/renucleation rates.

35. A razor cartridge comprising:

a housing;

a razor blade mounted in the housing; and within the housing, a phase change material.

36. A razor comprising:

a handle, a head, mounted on the handle, within the head, a phase change material, wherein melting of the phase change material thermally charges the razor, and an indicator, visible to a user of the razor, constructed to provide a visual indication to the user to indicate whether the razor is thermally charged.

37. The razor of claim 36 wherein the visual indication comprises a color change.

38. The razor of claim 37 wherein the indicator comprises a thermochromic material.

39. The razor of claim 36 wherein the indicator comprises a strip positioned on the razor head.

40. The razor of claim 36 wherein the indicator comprises a thermochromic material distributed through the material of the head.

41. The razor of claim 36 wherein the indicator is constructed to indicate the degree to which the razor is thermally charged.

42. The razor of claim 36 wherein the indicator displays an alphanumeric indicia or logo to indicate when the razor is thermally charged.

43. The razor of claim 42 wherein the indicia or logo appears when the razor is thermally charged.

44. A razor comprising:

a handle, a head, mounted on the handle, and within the handle, a phase change material.

45. A razor comprising:

a handle, a head, mounted on the handle, within the head, a phase change material, wherein melting of the phase change material thermally charges the razor, and on the head, a strip constructed to deliver a lubricious substance to the user's skin;

wherein the phase change material is positioned with respect to the strip so as to increase the rate of delivery of the lubricious substance relative to the rate at which it would be delivered if the phase change material were not present.

46. A method of shaving a mammal, the mammal having skin comprising:

(a) providing a razor head containing a phrase change material which stores latent heat when melted and releases the heat during recrystallization, (b) contacting the phase change material with water that is sufficiently warm to melt the phase change material, and then, (c) contacting the skin with the razor head.

47. The method of claim 46 further comprising repeating steps (a) and (b) during shaving.

48. The method of claim 46 wherein the razor head includes an indicator constructed to indicate whether the phase change material has melted, and the method further comprises observing the indicator.

* * * * *

UNITED STATES PATENT AND TRADEMARK OFFICE

CERTIFICATE OF CORRECTION

PATENT NO. : 6,868,610 B2
DATED : March 22, 2005
INVENTOR(S) : Klaus Brandt et al.

It is certified that error appears in the above-identified patent and that said Letters Patent is hereby corrected as shown below:

Title page,
Item [56], References Cited, FOREIGN PATENT DOCUMENTS, insert
-- FR 991,281, 10/03/51. --.

Column 7,
Line 44, before "." insert -- , the phase change material storing latent heat when melted and releasing the heat during recrystallization --.

Column 8,
Line 67, before "." insert -- , the phase change material storing latent heat when melted and releasing the heat during recrystallization, --.

Column 9,
Line 4, after "material" insert -- , the phase change material storing latent heat when melted and releasing the heat during recrystallization, --.
Line 30, before "." insert -- , the phase change material storing latent heat when melted and releasing the heat during recrystallization --.

Column 10,
Line 16, delete "(a) providing a razor head containing a phase change material which stores latent heat when melted and releases the heat during recrystallization," and replace with -- (a) contacting a razor head containing a phase change material with water that is sufficiently warm to melt the phase change material, and then, (b) contacting the skin with the razor head. --.
Line 30, after "material" insert -- , the phase change material storing latent heat when melted and releasing the heat during recrystallization, --.

Signed and Sealed this

Eighteenth Day of October, 2005

JON W. DUDAS
*Director of the United States Patent and Trademark Office*